United States Patent [19]

Bergman et al.

[11] 4,409,773

[45] Oct. 18, 1983

[54] COIN WRAPPING MACHINE

[75] Inventors: Charles T. Bergman; Robert L. Zwieg, both of Watertown, Wis.

[73] Assignee: Brandt, Inc., Watertown, Wis.

[21] Appl. No.: 253,917

[22] Filed: Apr. 14, 1981

[51] Int. Cl.[3] ..... B65B 57/14; B65B 57/11

[52] U.S. Cl. ..... 53/54; 53/212

[58] Field of Search ..... 53/54, 212, 500, 532; 133/1 A, 8 A

[56] References Cited

U.S. PATENT DOCUMENTS

| | | | |
|---|---|---|---|
| 2,635,402 | 4/1953 | Jorgensen | 53/113 |
| 3,382,647 | 5/1968 | Davey | 53/532 |
| 3,416,291 | 12/1968 | Uchida | 53/78 |
| 3,469,365 | 9/1969 | Uchida et al. | 53/54 |
| 4,040,434 | 8/1977 | Watanabe | 133/1 A |
| 4,058,954 | 11/1977 | Asami | 53/54 |
| 4,089,151 | 5/1978 | Bergman et al. | 53/59 R |
| 4,098,056 | 7/1978 | Ozaki | 53/212 |
| 4,219,985 | 9/1980 | Uchida et al. | 53/212 |
| 4,235,061 | 11/1980 | Watanabe | 53/54 |

*Primary Examiner*—John Sipos

*Attorney, Agent, or Firm*—Quarles & Brady

[57] ABSTRACT

An automatic coin wrapping machine has a coin dispenser which forms coins into a single file and moves them along a track past a counting star wheel to a downwardly curved discharged chute. Coins leaving the discharge chute enter a stacking tube where they are formed into a stack. The bottom of the tube is closed by a movable gate which is vibrated to assist stacking. The formation of a proper stack is sensed by an optical sensor that checks the height of the stack. When a proper stack is formed, the gate is removed and the stack of coins is lowered on a rod to a wrapping section in which three wrapping rollers engage a web of paper and wrap the paper about the stack. Crimping hooks fold over the extending ends of the wrapper and the completed roll is discharged.

The width of the track and discharge chute are adjustable for different denominations of coins. One side of the adjustable track and chute is formed on a plate which is pivotally mounted at the rear of the frame of the machine. The other side of the track and chute if formed on a plate which slides over the first plate and moves parallel to it. Adjustment is accomplished relative to a side frame so that the center of the discharge chute is always at the center of the stacking tube. If the stack sensor determines that an improper stack has been formed, the stacking tube is moved laterally and is opened to empty its contents into a reject chute.

15 Claims, 9 Drawing Figures

FIG.2
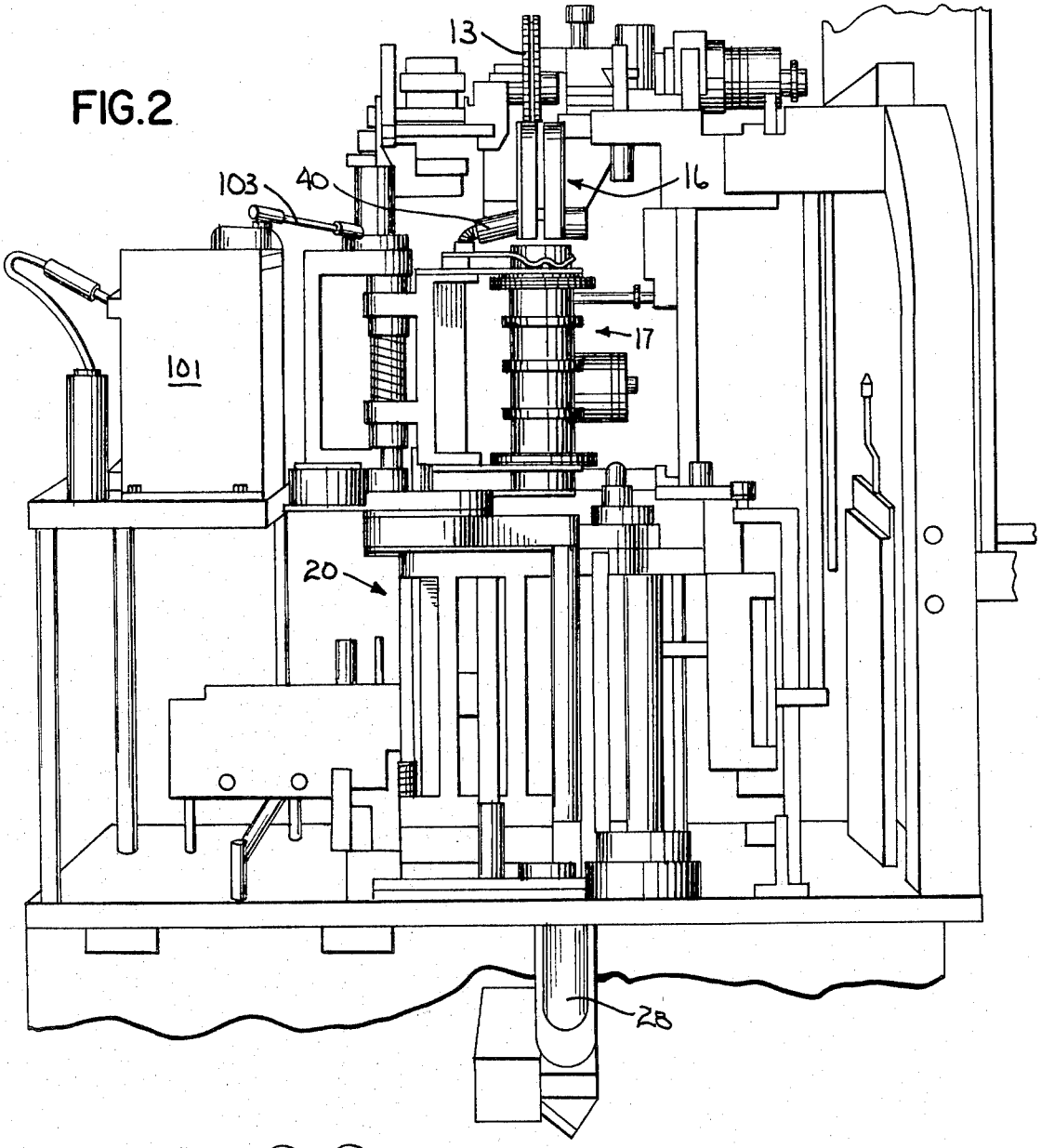
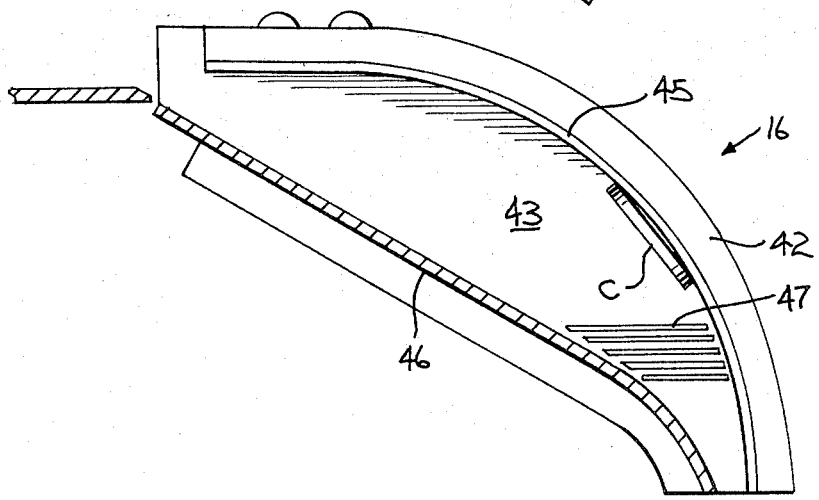
FIG.8

COIN WRAPPING MACHINE

BACKGROUND OF THE INVENTION

This invention relates to automatic coin wrapping, and more particularly to a machine for automatically packaging coins into rolls.

Coins are often formed into rolls and wrapped for ease in handling. The rolls vary in size and quantity of coins depending upon the particularly denomination so that different sizes of wrappers are required. However, there is a standard size of roll for each denomination of coins. Automatic equipment to form the standard rolls of coins is well known. The equipment generally includes a coin dispensing and counting section in which coins of one denomination are fed single file and the file is counted. The coins are fed to a section in which a stack of coins is formed and the flow of coins from the dispensing and counting section is halted when a stack of the proper quantity for the denomination has been formed. From the stack forming section, the stack is typically moved to a wrapping section in which a web of paper is wrapped around the stack. The ends of the wrapper are typically rolled over, or crimped, to complete the roll and the completed roll is discharged from the machine.

Examples of such automatic wrapping equipment include the machine of U.S. Pat. No. 4,089,151 issued May 16, 1978 to Bergman et al. The machine of such patent forms and wraps the stack in a single tube which is unique to the denomination being packaged. Another example is found in U.S. Pat. No. 2,635,402 issued Apr. 21, 1953 to Jorgensen. In the coin wrapping machine of that patent the stack of coins is formed in an open-ended tube which is pivoted to an opening in the floor over which it rides so that the stack of coins can fall into a wrapping tube having peripheral openings through which driven rollers project to wrap the paper web about the stack of coins. Still another example is the machine shown in U.S. Pat. No. 3,416,291 issued Dec. 17, 1968 to Uchida and U.S. Pat. No. 3,469,365 issued Sept. 30, 1969 to Uchida et al. In the machine of these two patents the stack is formed in a split cylinder which is opened to permit the stack to be removed laterally from the open tube to a position where three rollers will engage the web and wrap it about the stack which is positioned at the center of the rollers. Still another form of packaging machine is illustrated in U.S. Pat. No. 4,219,985 issued Sept. 2, 1980 to Uchida et al. In the machine of that patent, the stack is formed in a separate tube, a split floor beneath the tube is opened, and the formed stack is lowered by a coin support to a position beneath the stacking tube where it is engaged by three wrapping rollers which wrap the stack with a section of paper web removed from a roll.

The proper formation of the stack prior to its wrapping is of critical importance, particularly in those automatic coin wrapping machines which form the stack at a point removed from the wrapping section of the machine. If the coins are not formed into an integral stack with each coin laying squarely on top of the coin beneath it, upon movement to the wrapping section the stack may lose its integrity so that the coins will tumble in an uncontrolled fashion within the machine. An improperly formed stack could also travel to the wrapping section and be wrapped in an irregular manner so that as soon as it is discharged from the wrapping section the roll would open and discharge loose coins.

We have provided improvements to coin wrapping machines which insure the proper formation of the stack of coins and which will positively remove from the machine and prevent transfer to the wrapping section any stack which is determined to be improperly formed.

SUMMARY OF THE INVENTION

In accordance with our invention we have provided, in a coin wrapping machine having a coin dispensing and counting mechanism for providing a predetermined quantity of coins of a single denomination and a wrapping section for wrapping a formed stack of coins with sheet material, a stacking tube mounted for movement between a coin receiving position in which it receives coins one at a time from such dispensing and counting mechanism and a coin reject position, a detector for determining when an improper stack is formed in said tube, and means for shifting the tube to the reject position to discharge coins when the detector determines the formation of an improper stack.

The invention may further reside in such a coin wrapping machine in which the bottom of the coin stacking tube is positioned above the wrapping section when in the coin receiving position and the bottom is closed by a removable gate which is vibrated during formation of a stack of coins in the tube.

The invention may also reside in such a coin wrapping machine in which the stacking tube is formed of two semi-circular tube halves held together by yieldable means and with the halves being opened when the stacking tube is moved to the reject position.

The invention may also reside in such a coin wrapping machine in which the dispensing and counting mechanism includes a track leading to a discharge chute, and in which the track and chute are adjustable to accommodate different widths of coin while maintaining the center line of the exit of the discharge chute at the center of the tube when the tube is in its coin receiving position.

It is an object of the present invention to provide a coin wrapping machine having improved features for insuring the proper formation of a coin stack prior to wrapping of the stack.

It is a further object of the invention to provide a coin wrapping machine in which an improperly formed stack is rejected and moved to a collection point which is out of the train of normal flow of coins through the machine.

It is still a further object of the invention to provide a simplified mechanism for adjusting the width of the track and chute leading from the coin dispenser to the coin stacking tube.

The foregoing and other objects and advantages of the invention will appear in the following detailed description. In the description reference is made to the accompanying drawings which illustrate a preferred embodiment of a machine incorporating the inventive features.

BRIEF DESCRIPTION OF THE DRAWINGS

FIG. 2 is a front view in elevation of the coin wrapping machine with the outer housing removed;

FIG. 8 is a view in vertical section through the discharge chute at the end of the track.

DETAILED DESCRIPTION OF THE PREFERRED EMBODIMENT

Figure 1:
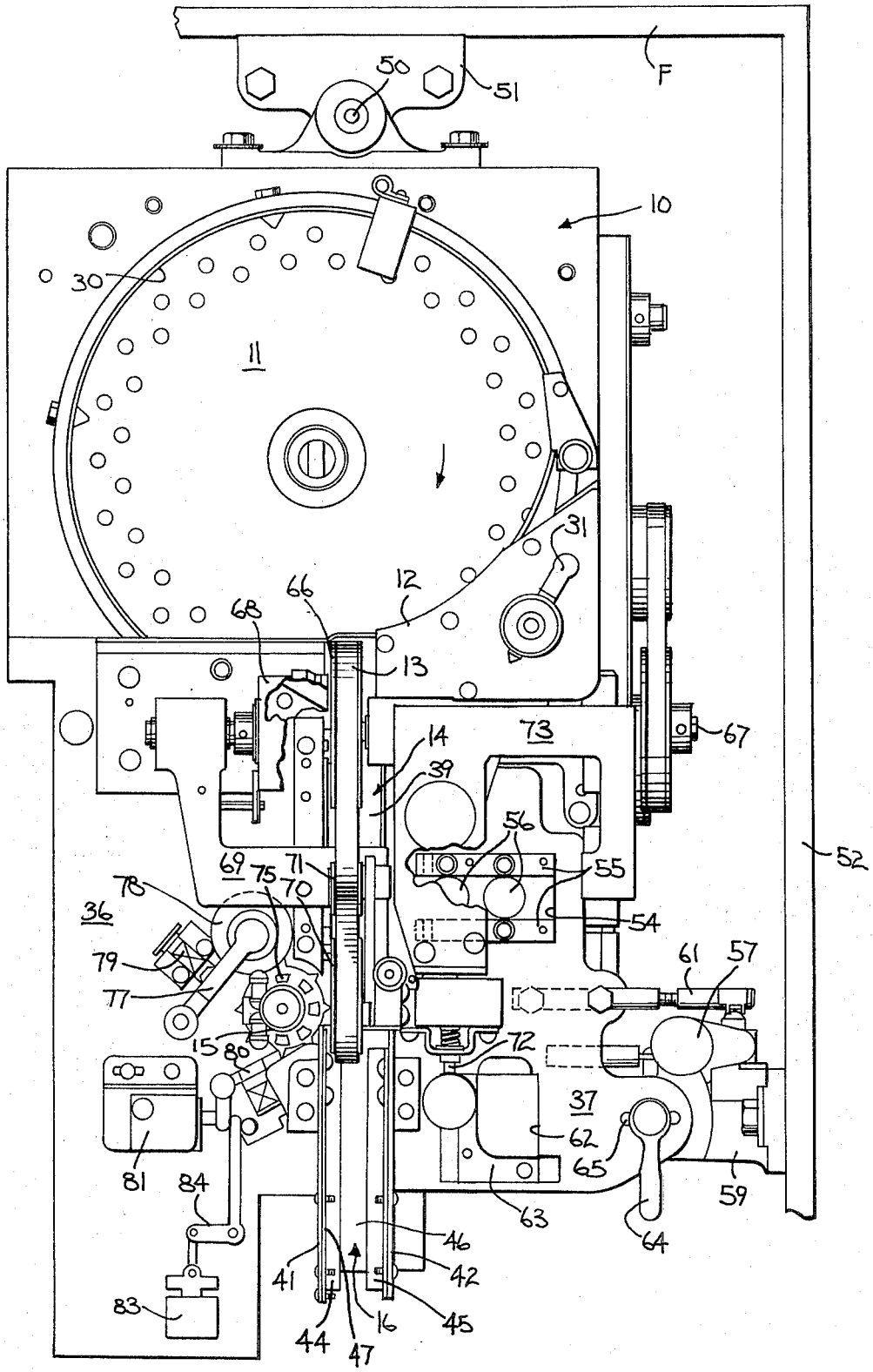
FIG. 1 is a top plan view of the machine with the outer housing removed and with the structural framework for the machine partially illustrated.
Figure 3:
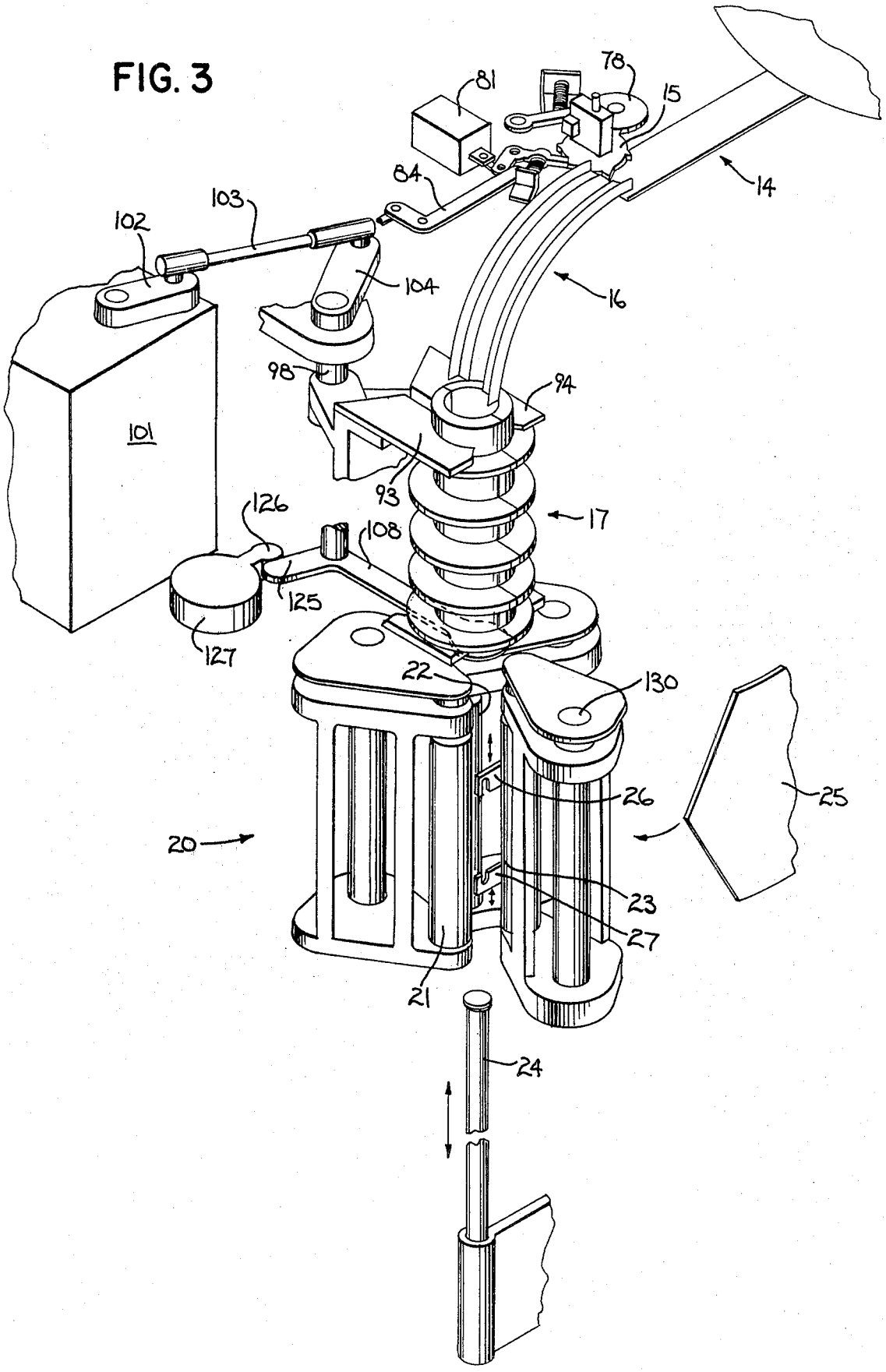
FIG. 3 is a view in perspective of a portion of the machine illustrating the relationship of the coin track, discharge chute, coin stacking tube, and wrapping sections of the machine.

Before describing the details of construction and operation of the coin wrapping machine, it will be helpful to understand the overall machine arrangement and operation. The coin wrapping machine includes a coin dispenser 10 which has a rotating horizontal disc 11 that receives coins of a single denomination and, upon rotation, forms them into a single file and delivers them to an exit opening 12. Coins delivered to the exit opening 12 are engaged by the lower run of a driven conveyer belt 13 and caused to pass down a track 14 past a star wheel 15 which both counts the passage of coins and halts the flow of coins when a predetermined quantity have been counted. Coins on the track 14 which are forced past the star wheel 15 are fed into a discharge chute 16 which is formed as an extension of the track 14. The chute 16 direct coins downwardly to the open top of a coin stacking tube 17. The open bottom of the coin stacking tube 17 is closed by a movable gate 18. Positioned directly beneath the bottom of the coin stacking tube 17 is a wrapping section identified generally by the reference numeral 20 and which includes three wrapping rollers 21, 22 and 23. A vertically movable coin support rod 24 is positionable beneath the gate 18 to receive and support the stack of coins after the gate 18 is opened and to lower the stack into the space between the wrapping rollers 21, 22 and 23. A web 25 of paper may be fed to the wrapping section 20 in a known manner. The web 25 is engaged by the rollers and is wrapped tightly about the stack. Crimping hooks 26 and 27 are actuable to fold over and crimp the top and bottom protruding ends of the web after it has been wound around the stack. The stack support rod 24 is moved out of the way so that a completed roll can be discharged out of an exit chute 28.

As is well known, the rotating disc 11 forms the bottom of a relatively shallow hopper defined by an upstanding annular flange 30. Coins are carried along the rotating disc 11 by centrifical force into the exit opening 12 which is adjustable to the height of the coin denomination to be wrapped. A lever 31 is provided to manipulate the height of the exit opening. Coins of a greater thickness, and therefore of improper denomination, will not be permitted to enter the exit opening and cannot pass to the track 14.

Figure 5:
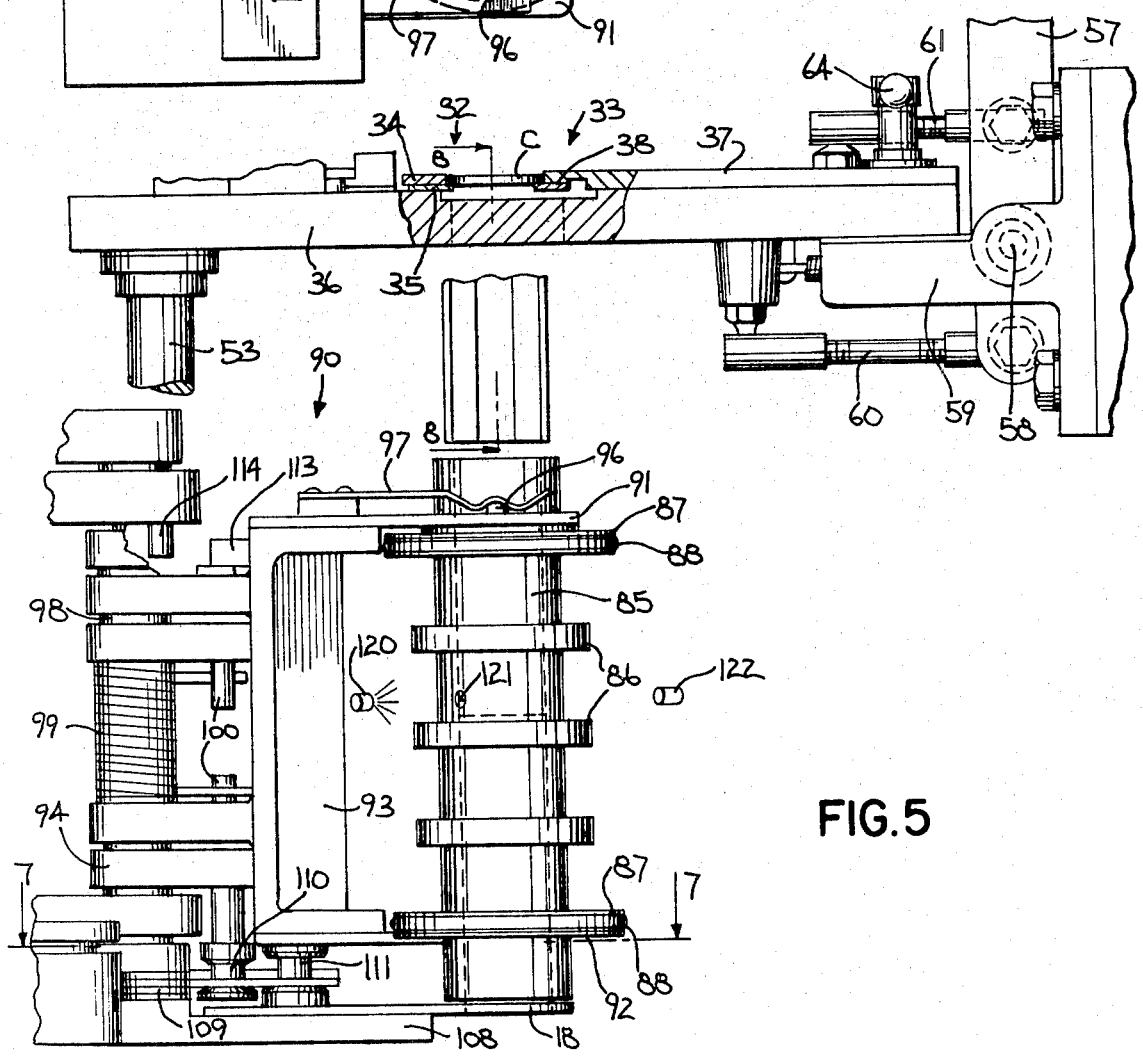
FIG. 5 is a front view in elevation of the portion of the machine illustrated in FIG. 4.

Coins which are of a thickness sufficiently small to pass the exit opening 12 will encounter the lower run of the ejector conveyer belt 13 and will be driven by that conveyer belt 13 along the track 14. The track 14 is defined by spaced left and right track portions 32 and 33, respectively (see FIG. 5). The left track portion 32 includes a pair of horizontal plates 34 and 35 which are staggered with respect to each other to form a lip and both of which are mounted on a mounting plate 36. The right track portion 33 is formed on a slide plate 37 disposed over the top surface of the mounting plate 36 on the right side of the center line of the track. The slide plate 37 mounts a laterally projecting plate 38 on its undersurface which forms a lip defining the other side of the track. The mounting plate 36 is recessed in the area of the track and includes an opening 39 in an area beneath the lower run of the eject conveyer belt 13 and at a location prior to the star wheel 15. As shown in FIG. 5, a coin will rest on the lips formed on the track portions 32 and 33 as it is propelled down the track. If the coin is of an improper denomination such that it is too narrow for the track it will fall through the opening 39 and into an offsort chute 40 in a known manner.

The discharge chute 16 is formed of left and right chute sections 41 and 42 which are mounted upon and project forwardly from the mounting plate 36 and the slide plate 37, respectively. The chute sections 41 and 42 each include a side wall 43 and an inwardly projecting curved flange 44 or 45, respectively. A floor 46 extends from one side 43 of a chute section. Coins will enter the discharge chute 16 at a high speed and will travel along the underside of the flanges 44 and 45 to the exit point of the chute 16. The floor 46 will catch any slow moving coin which for some reason fail to have sufficient velocity.

One side 43 of the chute 16 is provided with a gridwork 47 of electrical contacts. If coins jam at the exit point of the discharge chute 16, they will bridge the gridwork 47 thereby completing a circuit to halt the flow of coins.

The width of the track and the width of the chute 16 are adjustable together to accomodate different sizes of coins. To accomplish the adjustment, the mounting plate 36 is pivotally supported on the framework for the machine and the slide plate 37 is slidably mounted on top of the mounting plate 36. Specifically, the mounting plate 36 mounted on a pivot 50 having a vertical axis and, which is held in a bracket 51 mounted on a rear portion of the framework F for the machine (see FIG. 1). The mounting plate 36 also mounts the disc 11, the star wheel 15, and the ejector conveyer belt 13 together with their associated drives and other mechanism. A forward portion of the mounting plate 36 is supported on a pillar 53 and a Teflon tape or other low friction material is disposed on the top surface of the pillar 53 to allow the mounting plate 36 to move over it. The underside of the slide plate 37 is also provided with a low friction coating such as Teflon tape so that it can slide easily over the top surface of the mounting plate 36. The slide plate 37 includes an opening 54 which spaced parallel sides defined by a pair of parallel alignment blocks 55. Two round cam followers 56 which are aligned along a line which is normal to the left track portion 32 are disposed on the mounting plate 36 and are received between the alignment blocks 55. As will be appreciated, the cam followers 56 will maintain the slide block 37 in proper alignment as it is moved toward and away from the left track portion 32.

Movement of the slide plate 37 and the right track portion 33 relative to the mounting plate 36 and the left track portion 32 is accomplished by a lever 57 which includes an upwardly extending handle. The lever 57 is pivotly supported intermediate its ends on a horizontal pivot 58 supported in a bracket 59 which extends from the right side 52 of the framework F. The bracket 59 extends inwardly of the framework 52 beneath the mounting plate 36 for a short distance and supports the mounting plate. Its upper surface is also coated with a low friction material. The lower end of the lever 57 is connected by a linkage 60 to the underside of the mounting plate 36. A second linkage 61 connects the lever 57 to the top of the slide plate 37 at a point above the pivot 58. It will be apparent that movement of the lever 57 to and fro about the pivot 58 will result in movement of the mounting plate 36 by the linkage 60 and movement of the slide plate 37 by the linkage 61 in opposite directions. Thus, if the handle is moved to the left as viewed in FIG. 1 or 5, the width of the track 14 will be reduced while movement to the right will increase the track width. Since the left and right chute sections 41 and 42 are connected to the mounting plate 36 and slide plate 37, respectively, such movement will also adjust the distance between the side plates 43 of the chute sections 41 and 42.

The movement of the mounting plate 36 will be about the pivot 50 at the rear of the machine. The movement of the slide plate 37 will always be parallel to that of the mounting plate 36 since the cam followers 56 are disposed on the mounting plate 36 and align the slide plate 37 with respect to the mounting plate 36. The sides of the track and the discharge chute will always be maintained parallel with each other. Most importantly, the center line of the exit point of the chute 16 will always remain on line with the axis of the coin stacking tube 17. This is because the center line of the exit point of the discharge chute 16 is defined relative to the framework 52 of the machine and the coin receiving position of the coin stacking tube 17 is likewise maintained with respect to the framework 52 of the machine. The relationship can be appreciated by reference to FIGS. 1 and 4. The position of the pivot 50 for the mounting plate if fixed relative to the right side 52 of the framework F. Adjustment of the track 14 and chute 16 is accomplished from a reference point (the pivot 58) which is also fixed relative to the right side 52 of the framework F. As will appear hereafter, the stacking tube 17 is also fixed relative to the framework. Thus, adjustment of the width of the track and chute is accomplished without changing the center of the discharge from the chute 16 relative to the open top of the stacking tube 17.

Figure 4:
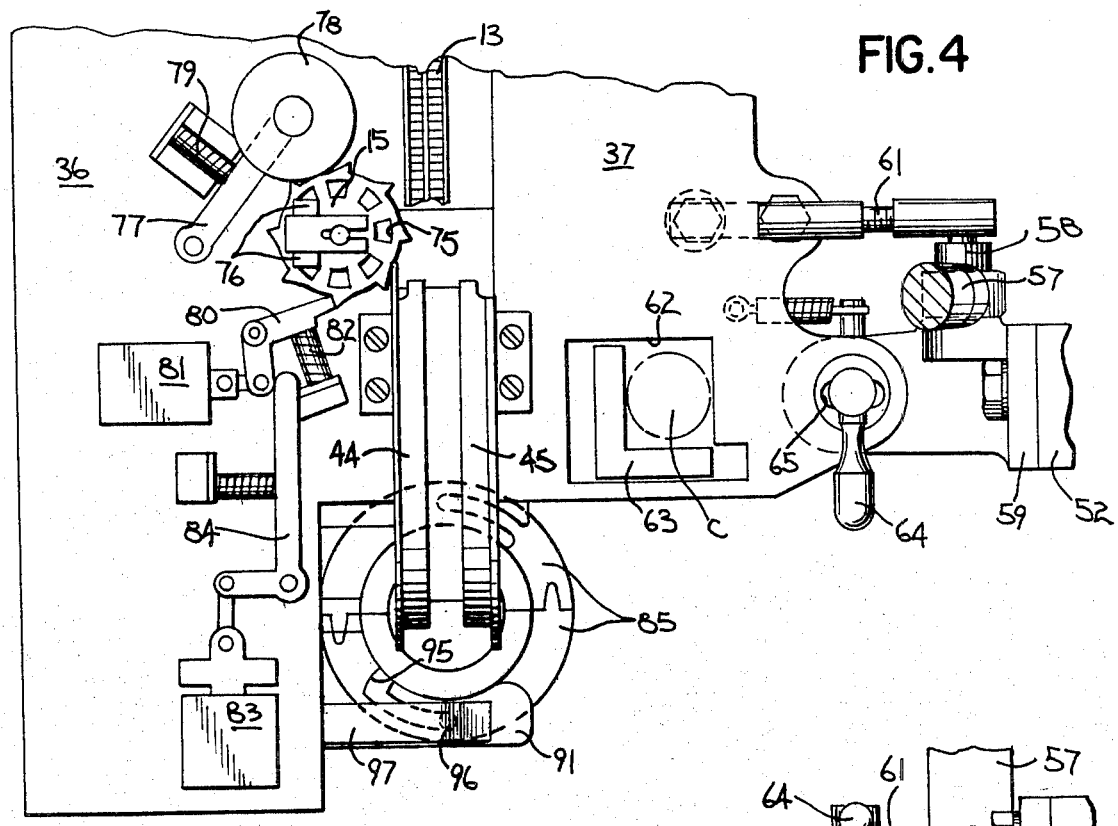
FIG. 4 is an enlarged top plan view of the front portion of the machine illustrating the counting mechanism and adjustment mechanism for the track and discharge chute.

A coin guide is provided to assist in adjusting the width of the track and chute to the proper dimension for the diameter of the particular coin being packaged. Specifically, a coin guide opening 62 is provided in the slide plate 37 and a coin locator bracket 63 is disposed on the mounting plate 36 within the coin guide opening 62. As seen in FIG. 4, a coin C of the denomination being packaged is placed within the coin guide opening 62 and against the coin locator 63. The slide plate 37 is then moved until the coin C abuts the opposing surfaces of the coin locator 63 and a coin guide opening 62. The slide plate 37 may be locked in position on the movable plate 36 by a locking lever 64 which has its shaft extending through a longitudinal slot 65 in the slide plate 37, and a similar slot in the mounting plate 36, and which is threadedly received in the bracket 59. By turning the lever 64 it will be threaded into the bracket 59 and will lock the slide plate 37 and the mounting plate 36 against movement relative to the framework 52.

The mechanism for mounting and driving the ejector conveyer belt 13 is similar to that which is illustrated and fully described in the aforesaid U.S. Pat. No. 4,089,151 and reference should be had to that patent for a full explanation. For the purpose of this application it is sufficient to note that the conveyer belt 13 is driven by a rear pulley 66 which is mounted on a drive shaft 67 and connected thereby by an electric clutch 68. A front ejector support 69 is journaled on the drive shaft 67 and mounts both a front pulley 70 and an idler pulley 71. An extension of the front support 69 mounts a spring loaded plunger 72 which is received in a detent in the front face of a rear ejector support 73 through which the drive shaft 67 is journaled. In the ejector mechanism of U.S. Pat. No. 4,089,151, the conveyor belt is disengaged from coins by raising the assembly so that the lower run of the belt could not engage coins in the track 14. In the present machine, the flow of coins is halted by de-energizing the clutch 68.

The conveyor belt 13 can be moved out of the way to expose the track 14 by releasing the plunger 72 from the detent and pivoting the front wheel support 69 together with the front pulley 70 and idler pulley 71 about the ejector drive shaft 67.

The star wheel 15 has eight points and is indexed one point for each coin which passes it. The rotation and indexing of the star wheel 15 is employed to count the coins passing along the track. The mechanism for counting the coins and for halting the flow of coins past the star wheel is more fully disclosed and described in the copending application of Robert L. Zwieg and Charles T. Bergman for Count Mechanism for Coin Dispensing Machine filed contemporaneous with this application. In summary, eight openings 75 are provided in the star wheel 15 and the top surface of the star wheel is plated so as to be highly reflective. A pair of sensors 76 each containing a light emitting diode and a photo cell are aimed at the top surface of the star wheel 15. When the light hits the reflective top surface it will bounce back and trigger a signal pulse in the photo electric cell. On the other hand, when an opening 75 is at the point of focus, there will be no reflection back to the sensor and there will be no pulse. The two sensors 76 are positioned in a staggered relationship to the spacing between the openings 75 in the star wheel 15, and a combination of signals from the two sensors 76 is used to count.

A lever arm 77 is pivotally mounted to the top of the mounting plate 36 and mounts a detent pawl 78 in the form of a large roller which rides the perimeter of the star wheel 15. The detent pawl is urged towards the star wheel by a spring 79 so that indexing of the star wheel 15 must be accomplished by the passage of a coin and the star wheel 15 is not free to rotate except by the force of a coin passing it. This prevents a false count due to the rotation of the star wheel 15 without the passage of a coin.

The star wheel 15 can be locked against rotation to halt the flow of coins past it and therefore to halt the flow of coins to the chute 16. This is accomplished by a latch member 80 in the form of a bell crank lever, one end of which engages the side of a tooth on the star wheel 15 and the other end of which is connected to a latch solenoid 81. A spring 82 urges the latch 80 to a position where it is in engagement with the star wheel 15. Energization of the latching solenoid 81 will hold the latch 80 out of engagement with the star wheel 15. At the end of the count of the desired quantity of coins, the latching solenoid 81 can be de-energized and the latch 80 will assume a position blocking further rotation of the star wheel 15. A power solenoid 83 is connected to one end of a releasing bell crank lever 84, the free end of which is connected to the end of the latching lever opposite the end which engages the star wheel 15. The power solenoid 83 and releasing lever 84 are provided to assist the latch solenoid 81 to release the latch member 80 from engagement with the star wheel 15.

Coins exiting the discharge chute 16 are discharged into the open end of the stacking tube 17. The stacking tube 17 is sized for the particular denomination of coin being handled by the machine at any particular time. That is, its interior diameter is matched to that of the diameter of the coin being wrapped. The tube 17 is formed of mating tube halves 85 each of which are in the form of a semicircular cylinder. Mating tongue and grooves extend along the lateral edges of the two tube halves 85. The tube halves are provided with a plurality or reinforcing ribs 86 and the ribs 87 adjacent the upper and lower ends of the tube 17 are each formed with a peripheral groove which receives an O-ring 88. The O-rings 88 are used to hold the two tube halves 85 during handling. The stacking tube 17 is releasably received within a tube support mechanism indicated generally by the numeral 90 which is supported on the framework of the machine. The support mechanism 90 includes pairs of upper and lower jaws 91 and 92, respectively, mounted on left and right tube arms 93 and 94, respectively. The jaws 91 and 92 have bayonet-type recesses 95 which receive an upwardly projecting pin 96 extending from the top and bottom ribs 87 of each of the tube halves 85. Leaf springs 97 hold the pins 96 on the top rib 87 against movement after the tube 17 has been seated in the jaws.

Figure 6:
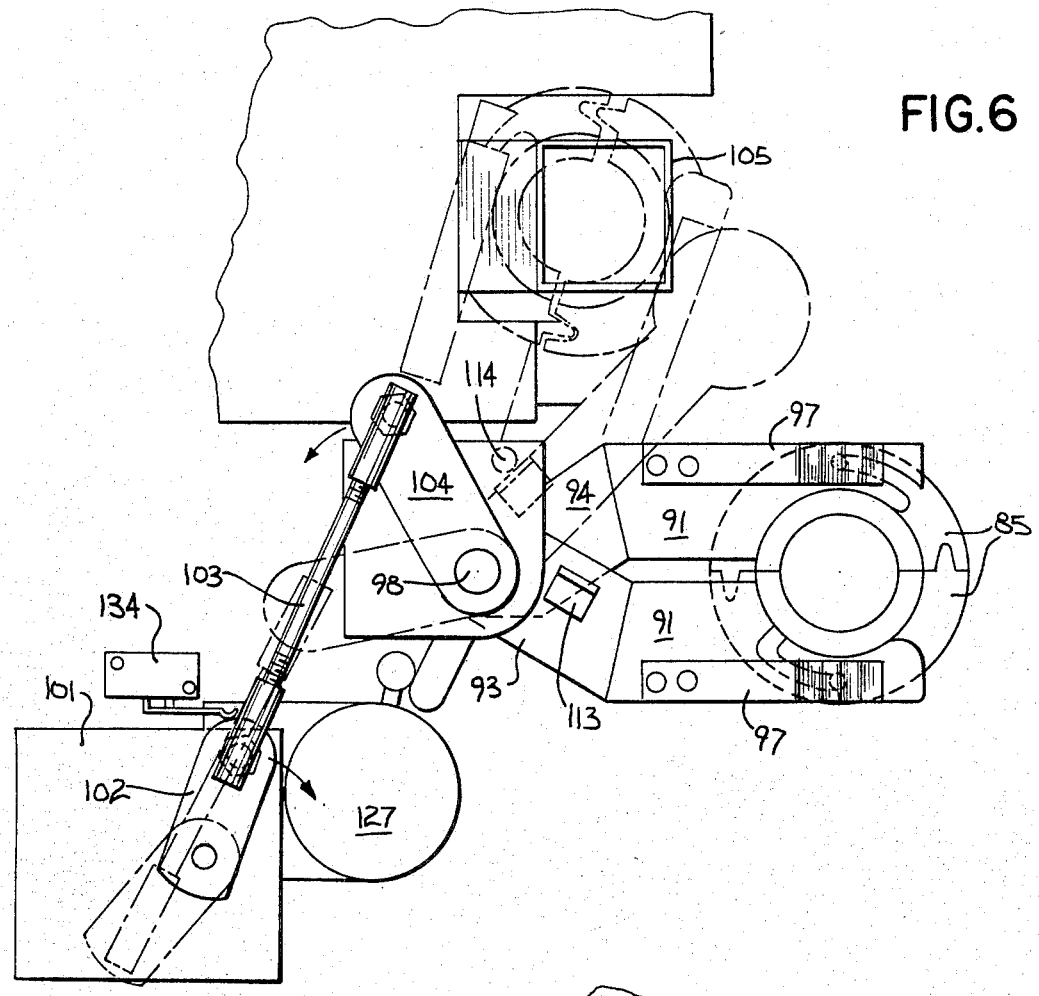
FIG. 6 is a top plan view of the mechanism for supporting the coin stacking tube.
Figure 7:
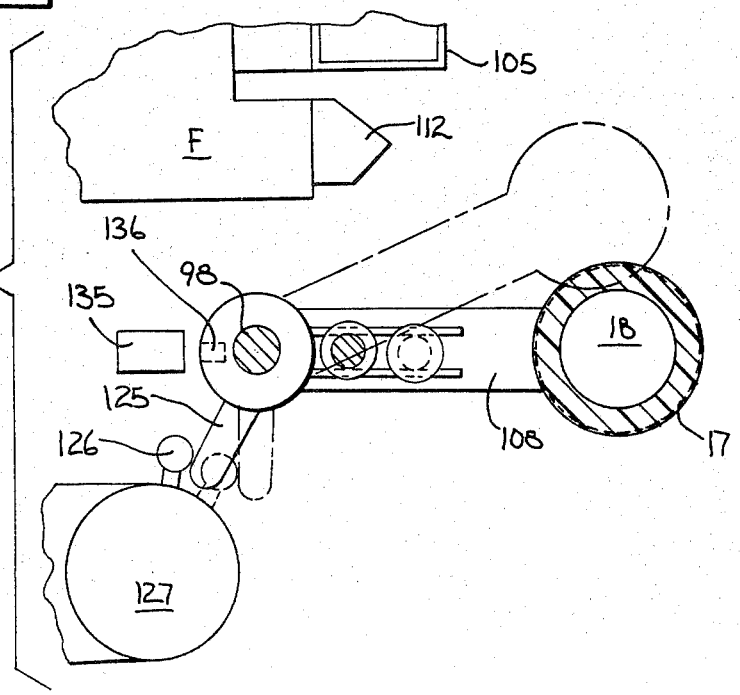
FIG. 7 is a view in horizontal section taken in the plane of the line 7—7 of FIG. 5 and illustrating the movable gate at the bottom of the coin stacking tube.

The left and right coin tube arms 93 and 94 are mounted on a common vertical shaft 98. The right arm 94 is keyed to the shaft 98 and the left arm 93 is journaled on the shaft 98. A torsion spring 99 has its ends engaging grooved pins 100 extending from the left and right tube arms 93 and 94 and urges the arms towards each other to a normal position in which the jaws hold together the sides of the tube halves 85. The normal, operating position for the coin tube 17 is directly below the exit of the discharge chute 16. The coin tube support mechanism 90 is operable to move the tube to a second, reject position and to dump the contents if it is determined that an improper stack of coins has been formed within the tube 17. To accomplish the displacement of the coin tube support mechanism 90 and the tube 17 there is provided a motor 101 whose output shaft mounts a link 102 connected by an adjustable linkage 103 to a link 104 secured to the upwardly projecting end of the shaft 98 which mounts the left and right tube arms 93 and 94. As shown in FIG. 6, energization of the motor 101 will rotate the link 104 and therefore the shaft 98 in a counterclockwise direction as viewed from the top of the machine. Both of the tube arms 93 and 94 are rotated with the shaft 98 in a counterclockwise direction to a point where the center of the tube 17 is over the entrance to a reject coin chute 105.

As previously indicated, the bottom of the coin tube 17 is normally closed by a movable gate 18. The gate 18 is formed on the end of an arm 108 which is rotatably mounted on the end of the shaft 98 which mounts the tube arms 93 and 94. The gate 18 is normally maintained in a position beneath the tube 17 by a torsion spring 109 which has its extending ends engaging the sides of pins 110 and 111 which are connected to the underside of the right tube arm 94 and the top side of the gate arm 108, respectively. The torsion spring 109 will tend to maintain the pins 110 and 111 in alignment with the gate 18 beneath the tube 17. As the tube support mechanism 90 is rotated under the action of the motor 101, the gate 18 will rotate with the right arm 94 and the tube 17 until the gate arm 108 encounters a gate stop 112 mounted to the framework. The gate stop 112 is so positioned relative to the entrance to the reject chute 105 that the gate 18 will be stopped just as the perimeter of the gate 18 reaches the edge of the entrance to the chute 105 (see FIG. 6). Thus, when the motor 101 has moved the support mechanism 90 through a full range of motion, the bottom of the tube 17 will be open and positioned over the reject chute 105. This will allow coins to fall out of the open stacking tube 17.

To assist the discharge of coins from the tube 17 into the reject chute 105, the tube halves 85 are opened slightly. This is accomplished by halting the rotation of the left tube arm 93 prior to full rotation of the right tube arm 94. The left tube arm 93 mounts an abutment bracket 113 which engages a pin 114 depending from a support for the upper end of the shaft 98 before the rotation of the shaft 98 is completed. This will open the tube halves 85. The torsion spring 99 will urge the two halves 85 together, assisted by the O-rings 88, as the motor 101 is actuated to return the tube support mechanism 90 to its normal, coin receiving position.

To determine whether a proper stack of coins has been formed within the tube 17, the height of the stack within the tube is monitored by the use of a light beam and a photo cell pickup. As shown schematically in FIG. 5, a light source 120 is positioned to one side and directed towards an opening 121 in the tube 17. A like opening is formed in the diametrically opposed wall of the tube so that if there is no obstruction within the tube 17, at the level of the opening 121, the light beam will pass through the tube 17. A photo cell 122 is positioned to the side of the tube 17 opposite the light source 120. If the coins have been properly stacked within the tube 17 and there are no coins on edge or partially on edge, the height of the proper formed stack will be below the opening 121 and the light beam will be unbroken. If an improper stack is formed, the light beam will be broken and this will provide a signal to actuate the motor 101 and shift the tube 17 to a position where the coins within the tube are released into the reject chute 105 which leads to a collection point out of the way of the wrapping section 20.

To assist in the proper formation of a coin stack within the tube 17, means are provided to vibrate the gate 18. The means for vibrating the gate is also employed to move the gate 18 out of the way to allow a proper stack of coins to be removed from the bottom of the tube 17 and transferred to the wrapping section 20 of the machine. Specifically, the gate arm 108 includes a laterally projecting finger 125 which is engageable by the actuator 126 of a rotary solenoid 127. When the rotary solenoid 127 is cycled on and off rapidly, the rotary actuator 126 will move in a tight arc between its home position and a position in which it engages and tends to move the finger 125. This will be transmitted through the gate arm 108 to vibrate the gate 18. The gate 18 will always seek its center, home position under the urgings of the torsion spring 109. The vibration which is established in the tube 17 as a result of the vibration of the gate 18 assists in settling the coins within the tube 17 and forming a proper stack. When the rotary solenoid 127 is fully energized, the actuator 126 will be moved through a full arc and the gate 18 is likewise moved through a full arc to move the gate 18 out from beneath the tube 17. The stack of coins within the tube 17 can thereafter be lowered by the rod 24 into the wrapping section beneath it. The actuator 126 of the rotary solenoid 127 engages the finger 125 only when the tube 17 is in its normal position.

The wrapping section 20 as such forms no part of the present invention. A number of conventional arrangements for mounting and driving the wrapping rollers may be employed. One form uses shiftable mounts which are movable through an arc about a vertical shaft 130 to move the roller 21 towards and away from the periphery of the stack. Similarly, the manner of feeding a section of paper web 25 to the wrapping section 20 is not a part of the present invention and conventional methods may be employed. Typically the web would be withdrawn from a roll of paper and automatically cut to a particular length for the size of the coin being handled.

The timing and inter-relationship of the feeding of the paper web 25 to the wrapping section 20, the engagement of the rollers 21, 22 and 23 with the stack, the application of the crimping hooks 26 and 27, and the raising and lowering of the support rod 24 may all follow conventional practices.

Figure 9:
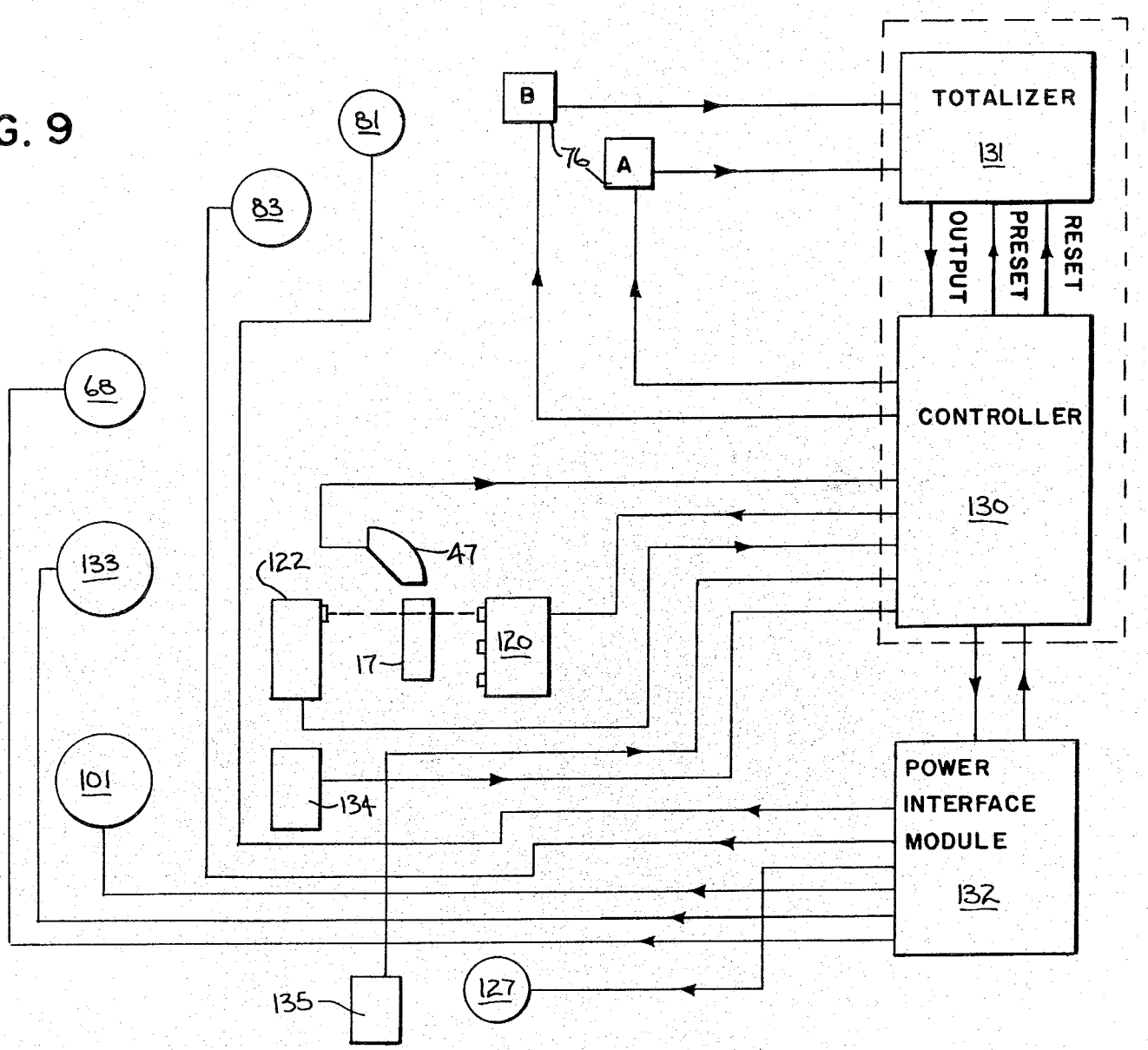
FIG. 9 is a schematic diagram of the portions of the electrical circuit for the machine involving the inventive features.

Referring to FIG. 9, those portions of the control system for the coin wrapping machine which are involved with the features and mechanisms of the invention are illustrated in schematic form. FIG. 9 shows the direction of flow of information and signals between various control and actuated elements of the circuit and does not show all of the electrical connections involved. The control includes a controller 130 which may include a microprocessor and which receives count signals from a count totalizer 131 and controls the setting and resetting of the totalizer. The controller receives signals from certain of the sensors already described and is operated by low voltage supplies. A power interface module 132 containing relays and power supplies is also controlled by the controller 130 and in turn controls the operation of solenoids and motors of the machine. The totalizer 131 receives the pulse signal from the two count sensors 76 and is cycled up and down to accurately reflect the count of coin passing the star wheel 15.

At the start of a dispensing and stacking cycle, the power solenoid 83 is pulsed by the power interface module 132 under signal from the controller 130 to release the star wheel 15 and allow the energized latch solenoid 81 to hold the latch member 80 in the release position out of engagement with the star wheel 15. The ejector conveyor belt clutch 68 is energized so that power from a drive motor 133 for the disc 11 can also be transmitted to the drive shaft 67 to drive the conveyor belt 13. As coins are forced past the star wheel 15, two signals 90° out of phase are generated by the sensors 76. These are inputted to the totalizer 131 and are decoded and totalized by the totalizer 131. If a coin does not properly exit the discharge chute 16, the jam that is created will bridge the gridwork 47 and create a signal which is fed back to the controller 130 and that signal will cause the controller to stop the coin flow immediately by removing power to the disc motor 133 and by de-energizing the ejector conveyor belt clutch 68 to halt the coin flow.

When the correct quantity of coins for a stack has been delivered, the totalizer 131 signals the controller 130 which in turn will cause the power interface 132 to de-energize the latch solenoid 81 and de-energize power and de-energize the clutch 68 to halt the flow of coins.

As coins are being fed into the tube 17, a pulse signal is provided to the gate solenoid 127 to vibrate the gate 18. After a short delay to allow for settling of the coin stack within the tube 17, the controller 130 provides a signal to the light emitting diode 120 and the photocell receiver 122 of the stack detector. If light is visible through the opening in the tube 17, the gate solenoid 127 is energized to allow the stack within the tube 17 to drop to the wrapping section 30 of the machine. Should a misstack occur and light is therefore blocked by the improper stack in the tube 17, additional time is first allowed for settling after which the reject motor 101 is energized by the controller 130 through the power interface module 132. After the motor tube has shifted the support mechanism 90 to the coin reject position and returned the support 90 to its normal position, a limit switch 134 is tripped. When the gate 18 is displaced fully by the gate solenoid 127 or as a part of the action of the tube support mechanism 90 moving to the reject position, a gate limit proximity switch 135 is operated by a magnet 136 which signals the controller 130 with the results that the totalizer 131 is preset to initiate delivery of another quantity of counted coins and to form a stack therefrom.

It will be appreciated from the above description that improvements have been provided for coin wrapping machines to insure the formation of a proper stack of coins before the coins are wrapped with a web of paper or other sheet material. This is accomplished by maintaining the center of the exit of the discharge chute always at the center of the stacking tube and making track and chute adjustments relative to that point. It is also accomplished by providing agitation through vibration of the gate and by detecting the formation of an improper stack which is then rejected by moving the coins out of the normal machine flow path to a collection point so that an improper stack is neither lowered to the wrapping section where it could fall apart nor it is attempted to be wrapped.

We claim:

1. In a coin wrapping machine having a coin dispensing and counting mechanism for delivering a predetermined quantity of coins seriatum to a discharge chute, stacking means adapted to receive coins from said discharge chute to form a stack of coins, and wrapping means below and vertically aligned with said discharge chute adapted to receive a stack of coins from said stacking means and to form a wrapper about the stack, wherein said stacking means comprises:

an open stacking tube;

a support for said tube which is movable between an operative position in which the open top of said tube is disposed at the exit of the reject chute and a discharge position displaced laterally from said operative position;

a coin collector at said discharge position;

a detector for determining the formation of an improper stack in said tube; and means for shifting said support to said reject position to reject said coins from said tube into said collector in response to said detector only when said detector determines the formation of an improper stack.

2. A coin wrapping machine in accordance with claim 1 together with a movable gate normally closing the bottom of said tube, said gate being movable away from said tube to allow transfer of the stack of coins to said wrapping means and to allow reject of coins into said coin collector.

3. A coin wrapping machine in accordance with claim 2 together with means for vibrating said gate to assist in forming a proper stack of coins in said tube.

4. A coin wrapping machine in accordance with claim 2 wherein said movable gate is yieldably mounted on said tube support to shift therewith, together with a stop disposed in the path of travel of said gate to halt the movement of the gate before the support has completed its movement from the operative position to the reject position.

5. A coin wrapping machine in accordance with claim 4 together with a rotary electrical actuator engageable with said gate when said support is in said operative position, said actuator being operable upon full energization to move said gate away from the bottom of said tube and being operable to vibrate said gate when cycled on and off.

6. A coin wrapping machine in accordance with claim 2 wherein said tube comprises a pair of mating semicircular tube halves which are held together when in said operative position, said support opening said tube halves when the support is moved to said reject position.

7. A coin wrapping machine in accordance with claim 6 wherein said tube is removably mounted in said support so that tubes sized for different denominations of coins can be received in said support, and wherein the tube halves are held together by elastomer bands which encircle the tube halves.

8. A coin wrapping machine in accordance with claim 6 wherein said support includes a pair of arms each holding one of said tube halves, together with a spring urging the arms to a position in which the tube halves are together, and a stop engagable by one of said arms when said support nears said reject position so that the other of said arms is thereafter moved by said support to open the tube halves.

9. A coin wrapping machine in accordance with claim 1 wherein said shifting means comprises an electrical actuator and said detector produces an electrical signal to energize said actuator when an improper stack is detected.

10. In a coin wrapping machine having a frame, a coin dispenser mechanism for forming coins of a particular denomination into a single file and delivering the file to the entrance to a track, means for moving coins seriatum down said track to a discharge chute, counting means responsive to the passage of coins along said track and adapted to halt the flow of coins after a predetermined number have been counted, stacking means adapted to receive coins from said discharge chute to form the coins into a stack, and wrapping means below and vertically aligned with said discharge chute adapted to receive a stack of coins from said stacking means and to form a wrapper around said stack, the improvement wherein said stacking means comprises:

an open upright stacking tube split longitudinally to form mating halves;

a support for said tube including a rotatable vertical shaft mounted on said frame, a pair of arms each holding one of said tube halves, one of said arms being mounted to rotate with said shaft and the other of said arms being journaled on said shaft, and a spring urging said other arm toward said one arm to hold the tube halves together;

means for rotating said shaft between a normal position in which the open top of said tube is beneath the exit of the discharge chute and a reject position in which the tube is shifted laterally of said discharge chute and wrapping means;

a detector to actuate said rotating means only in response to the detection of an improperly formed stack in said tube; and a stop on said frame engageable by said other arm to halt its movement before the completion of the rotation of the shaft to said reject position so that the tube halves are open at said reject position.

11. A coin wrapping machine in accordance with claim 10 together with a gate journaled on said shaft, said gate being yieldably connected to one of said support arms and being urged to a position closing the open bottom of said tube, and a gate stop on said frame engageable by said gate after said gate has moved with said support arm toward said reject position and before the reject position has been reached so that the gate is out of the way of the tube bottom when said tube is in said reject position.

12. A coin wrapping machine in accordance with claim 11 together with a reject chute having its entrance at said reject position to receive and collect coins released from said tube.

13. A coin wrapping machine in accordance with claim 11 together with a rotary solenoid engageable with said gate when said shaft is in its normal position and adapted when energized for a sustained period to rotate said gate about said shaft to open the bottom of said tube, said rotary solenoid being further adapted to vibrate said gate when cycled on and off.

14. A coin wrapping machine in accordance with claim 10 wherein one side of said track is formed on a mounting plate which mounts said moving means and said counting means, said mounting plate being pivotably mounted to said frame about a vertical axis at a point remote from said discharge chute, the other side of said track being formed on a plate disposed to slide over said mounting plate in a direction normal to said one side of said track, said discharge chute is formed of complementary halves mounted on said mounting plate and said slide plate respectively, and means for adjusting the width of said track and discharge chute by sliding said slide plate over said mounting plate.

15. A coin wrapping machine in accordance with claim 14 wherein said adjusting means includes a lever pivotably mounted on said frame intermediate its ends, one of its ends connected by a linkage to said mounting plate and the opposite end being connected by a linkage to said slide plate.

* * * * *